United States Patent [19]

Blank et al.

[11] 4,350,566

[45] Sep. 21, 1982

[54] PROCESS FOR THE DELIGNIFICATION OF LIGNOCELLULOSE MATERIALS WITH DINITROANTHRAQUINONES

[75] Inventors: Heinz U. Blank, Odenthal; Günther Klag, Leverkusen; Peter Schnegg, Odenthal, all of Fed. Rep. of Germany

[73] Assignee: Bayer Aktiengesellschaft, Leverkusen, Fed. Rep. of Germany

[21] Appl. No.: 257,842

[22] Filed: Apr. 27, 1981

Related U.S. Application Data

[63] Continuation of Ser. No. 158,022, Jun. 9, 1980, abandoned.

[30] Foreign Application Priority Data

Jun. 25, 1979 [DE] Fed. Rep. of Germany ..... 2925544

[51] Int. Cl.[3] ..... D21C 3/02

[52] U.S. Cl. ..... 162/72; 162/90

[58] Field of Search ..... 162/72, 90

[56] References Cited

U.S. PATENT DOCUMENTS 4,036,680 7/1977 Holten et al. ..... 162/90

4,178,861 12/1979 Vanderhoek et al. ..... 162/72

OTHER PUBLICATIONS

Richter, Textbook of Organic Chemistry 2nd Edition, New York, John Wiley & Sons Inc.

*Primary Examiner*—Steve Alvo

*Attorney, Agent, or Firm*—Sprung, Horn, Kramer & Woods

[57] ABSTRACT

A process for delignifying lignocellulosic material with a digestion liquor of nitroanthraquinones and/or dinitroanthraquinones. The process can be carried out in a closed reaction vessel at temperatures of 150°-200°± C. for 0.5 to 480 minutes with 0.001 to 10% nitroanthraquinone and/or dinitroanthraquinone by weight of lignocellulosic material.

4 Claims, No Drawings

PROCESS FOR THE DELIGNIFICATION OF LIGNOCELLULOSE MATERIALS WITH DINITROANTHRAQUINONES

This is a continuation of application Ser. No. 158,022, filed June 9, 1980, now abandoned.

The invention relates to a process for the delignification of lignocellulose materials by adding nitroanthraquinone compounds.

It is known that in the delignification of lignocellulose materials according to the soda process, the Kraft process or the different sulphite processes there can be achieved advantageous effects with respect to yield and quality of the pulp obtained and/or with respect to savings in chemicals, time and energy by the addition of auxiliaries to the digestion liquors. As auxiliaries are especially mentioned cyclic keto compounds especially anthraquinone (see B. G. Fiehn Zellstoff und Papier 21, 3 (1972); H. H. Holton, Pulp and Paper Can. 78, T 218 (1977), U.S. Pat. Nos. 4,012,280 and 4,036,681.

Svensk Papperstidning 71, pages 857–863 (1968) reports that nitrobenzene and nitrobenzoic acids have an inhibiting effect on the alkaline chain-shortening reaction in delignification. The same literature reference states however that this knowledge has not found industrial application.

The German published specification No. 27 55 769 describes the use of a combination of a cyclic keto compound with aromatic compounds. The effect achieved with these combinations is however too poor compared with the required amounts of the nitro compounds. Besides the low effectivity of these combinations they have the further disadvantage that they require because of the two components more complicated devices for dosage handling etc.

It was no found that nitroanthraquinone compounds constitute new effective auxiliaries in the delignification of lignocellulose materials. The present invention concerns therefore an improvement of the known processes for delignification of lignocellulose materials by digesting lignocellulose materials with customary digesting liquids under customary digestion conditions in the presence of auxiliaries; the improvement comprising carrying out the delignification in the presence of one or more nitroanthraquinone compounds.

The most diverse lignocellulose materials can be delignified by the process according to the invention. Examples of suitable materials are coniferous woods, such as spruce, pine and fir, leaf-woods, such as beech, birch, eucalyptus, aspen, poplar, willow, hornbeam, alder, oak and maple, and straw and bagasses of annual plants. Spruce, pine, fir, birch and beech are preferably delignified by the process according to the invention.

In the process, according to the invention, for the delignification of lignocellulose materials, one or more nitroanthraquinone compounds are added to the digestion liquid. One of the digestion liquids customary for alkaline digestion processes or sulphite processes or similar processes can be used as the digestion liquid. The term "alkaline digestion process" comprises various processes, for example the soda process, the sulphate process, the polysulphide process and the like, and the term "sulphite process" used in this context comprises various processes, for example the alkaline, neutral and acid sulphite process, the bisulphite process and the like (see P. Lengyel and S. Morvay, Chemie und Technologie der Zellstoffherstellung (Chemistry and Technology of the Production of Pulp), Güntter-Staib Verlag, Biberach/Riss, 1973, pages 62 et seq.). The additions according to the invention are preferably made to alkaline digestion liquids, such as are used, for example, in the processes known as the soda process, the sulphate process and the polysulphide process. The additions according to the invention are very particularly preferably made to alkaline digestion liquids such as are used in the process known as the soda process.

The process according to the invention can be carried out, for example, in a closed reaction vessel in which the lignocellulose material is treated with the digestion liquid at maximum temperatures in the range from 150° to 200° C., preferably from 160° to 180° C., over a period of 0.5 to 480 minutes, preferably of 15 to 200 minutes.

After this digestion treatment, the delignified material can be worked up in the customary manner, for example by displacing the digestion liquid from the lignocellulose material by adding water or an aqueous liquid which is inert towards the lignocellulose material. The lignocellulose material which has been thus treated and has optionally additionally been shredded by a mechanical means can be used without further treatment or can be subjected to customary bleaching processes.

Alternatively, the delignified lignocellulose material can be further treated in the following manner: the material, in an aqueous suspension containing 2 to 40% by weight of lignocellulose material, is treated with 2 to 20% by weight of an alkali metal base at 20° to 90° C. for 0.5 to 60 minutes and then optionally with oxygen or an oxygen-containing gas at a temperature of 80° to 150° C. and under a partial pressure of oxygen of 1.4 to 14 $kg/cm^2$ for 0.5 to 120 minutes.

If the lignocellulose material employed consists of wood, it is advantageous to convert it into chips beforehand.

The nitroanthraquinone compounds can also be already added to the lignocellulose material during the impregnation.

It can also be advantageous to allow the nitroanthraquinone compounds to act on the lignocellulose material, together with the digestion chemicals, in a pretreatment phase in the temperature range from about 90° to 150° C. in a manner such that the lignin content is not substantially dissolved, that is to say is dissolved to the extent of less than 20%, and such that, if appropriate, the proportion of nitroanthraquinone compounds which has not penetrated into the lignocellulose material can be recovered.

According to the invention, one or more nitroanthraquinone compounds are added in the digestion process. Possible nitroanthraquinone compounds are, for example, mono- and/or di-nitroanthraquinones, which can optionally contain one or more other substituents, in addition to the nitro groups. Other substituents which are possible are, for example, alkyl, alkoxy, halogen, amino, hydroxyl, carboxyl and/or sulpho groups and/or fused-on iso- or hetero-cyclic rings. Alkyl and alkoxy groups with in each case 1 to 4 C atoms and chlorine and/or sulpho groups are preferred as the other substituents. The number of other substituents can be, for example, 1 to 6, preferably 1 to 4. Examples of nitroanthraquinone compounds to be added are: 1- and 2-nitroanthraquinone; 1,5-, 1,6-, 1,7-, 1,8-, 2,6- and 2,7-dinitroanthraquinone; 1-nitro-5-, 1-nitro-7-, 1-nitro-8-sulpho-anthraquinone; 1-nitro-4-chloro-5-sulpho-anthraquinone; 1-nitro-5-, 1-nitro-6-, 1-nitro-8- and 2-nitro-1-chloro-anthraquinone; 2-nitro-4,5-dichloro-anthraquinone; 2-nitro-1,4- and 1-nitro-5,8-diamino-anthraquinone; 1-nitro-4-amino-anthraquinone; 1,3-dinitro-4-amino-anthraquinone; 1-nitro-4-hydroxyanthraquinone; 1-nitro-3,4-, 1-nitro-5,8- and 1,5-dinitro-4,8-dihydroxy-anthraquinone; 1,5-dinitro-4,8-dihydroxy-3,7-disulpho-anthraquinone; 1,8-dinitro-4,5-dihydroxy-anthraquinone; 1,5-dinitro-2,6-dihydroxy-3,7-disulpho-anthraquinone; 2-nitro-3,4,7-trihydroxy-anthraquinone; 1-nitro-4-ethoxy-anthraquinone; 1-nitro-2- and 2-nitro-3-carboxy-anthraquinone; 1-nitro-3-carboxy-4-amino-anthraquinone, 4,4'-dinitro-1,1'-dianthrimide; 1-nitro-4- and 2-nitro-1-methyl-anthraquinone; 1-nitro-4-bromo-anthraquinone; 1-nitro-3-sulpho-4-bromo-anthraquinone and 1-nitro-5-ethoxy-anthraquinone.

Instead of or in addition to the nitroanthraquinone compounds, it is also possible to use the partially nuclear-hydrogenated derivatives of nitroanthraquinone compounds and/or tautomeric forms thereof.

The compounds preferably added are 1- and 2-nitroanthraquinone, 1,5-, 1,6-, 1,7-, 1,8-, 2,6- and 2,7-dinitroanthraquinone, 1-nitro-5-chloro-anthraquinone, 1-nitro-8-sulpho-anthraquinone, 1-nitro-4-amino-anthraquinone, 1-nitro-4-hydroxy-anthraquinone, 1-nitro-2-carboxy-anthraquinone, 1-nitro-5-ethoxy-anthraquinone and/or 2-methyl-1-nitro-anthraquinone, especially the abovementioned dinitro compounds.

The abovementioned compounds can in each case be added by themselves or as any desired mixtures with one another.

It is particularly preferable to add mixtures which do not contain further-substituted mono- and/or di-nitroanthraquinones. Such mixtures can be obtained, for example, in the industrial nitration of anthraquinone and/or mononitroanthraquinone. In particular, mixtures of mono- and/or di-nitroanthraquinones which are obtained when anthraquinone is mono- or di-nitrated on an industrial scale and/or mono-nitroanthraquinone mixtures are nitrated and the isomers which are important, for example, as dyestuff intermediate products, for example 1-nitro- and 1,5- and/or 1,8-dinitro-anthraquinone, are separated off from the products thereby obtained, can be used in the process according to the invention. The mixtures mentioned last, which can contain as the essential constituents, for example, 1,5-, 1,6-, 1,7-, 1,8-, 2,6- and/or 2,7-dinitro-anthraquinone, were hitherto undesired by-products of the nitration of anthraquinone. Particularly preferred mixtures contain, for example, 0 to 3% by weight of 1-nitroanthraquinone, 5 to 12% by weight of 1,5-dinitroanthraquinone, 15 to 35% by weight of 1,6-dinitroanthraquinone, 15 to 35% by weight of 1,7-dinitroanthraquinone, 15 to 50% by weight of 1,8-dinitroanthraquinone, 0.5 to 3% by weight of 2,6-dinitroanthraquinone and 0.5 to 3% by weight of 2,7-dinitroanthraquinone.

The nitroanthraquinone compounds can be added, according to the invention in amounts of, for example, 0.001 to 10% by weight, relative to the lignocellulose material employed. 0.01 to 1.0% by weight of the additives, relative to the lignocellulose material, is preferably employed.

The process according to the invention has the advantage that it leads to a substantial acceleration of delignification in the soda process. A significant acceleration is also observed in the sulphate process and the polysulphide process. The process according to the invention furthermore has the advantage that substances and substance mixtures hitherto obtained as undesired by-products in the nitration of anthraquinone can be utilised in an industrially advantageous manner.

The increase in the rate of delignification can be utilised in various ways, depending on the circumstances. For example, a given Kappa number can be achieved in a shorter time, that is to say the capacity of a pulp digester which has already been installed can be increased. However, it is also possible to carry out the digestion at a lower maximum digestion temperature. Energy is saved in both cases. Instead of shortening the digestion time and/or lowering the maximum digestion temperature, the amount of chemicals used can also be reduced, which, as is known (see TAPPI, 50(8), page 400 (1967)), has a favourable effect on the decreased formation of highly odoriferous by-products. The manner in which these advantages can be put to optimum use in an individual case depends on the circumstances of the process used for pulp production.

In addition to accelerating the delignification, the process according to the invention also achieves a stabilising action on the cellulose, so that for a given Kappa number, a higher yield of pulp can be obtained.

EXAMPLE 1

Chips of spruce wood were digested, in a laboratory digester, with a soda digestion liquor which contained 22% of active alkali (relative to the weight of the wood). The ratio of liquid to wood was 4:1, the initial digestion time was 60 minutes and the final digestion time at 175° C. was 80 minutes (digestion A). A further digestion (digestion B) was carried out in the same manner, but 0.1% by weight (relative to oven-dried wood) of a dinitroanthraquinone mixture of the following composition was added to the mixture of wood and digestion liquor: 30.7% by weight of 1,8-dinitroanthraquinone, 27.1% by weight of 1,6-dinitroanthraquinone, 23.0% by weight of 1,7-dinitroanthraquinone, 10.0% by weight of 1,5-dinitroanthraquinone, 1.1% by weight of 2,7-dinitroanthraquinone, 1.0% by weight of 2,6-dinitroanthraquinone, 0.7% by weight of 1-nitroanthraquinone and 6.4% by weight of other nitroanthraquinone derivatives.

The following results were obtained in these digestions:

| | Kappa number | Pulp yield |
|---|---|---|
| Digestion A | 107 | 58.1% |
| Digestion B | 56 | 51.9% |

EXAMPLE 2

(a) Chips of spruce wood were digested in a soda digestion liquor which contained 22% of active alkali (relative to the weight of the wood). The ratio of liquid to wood was 4:1, the initial digestion time was 60 minutes and the final digestion time at 175° C. was 116 minutes. In this digestion, the pulp yield was 51.5% at a Kappa number of 67.

(b) The procedure followed was as in (a), but 0.1% by weight (relative to oven-dried wood) of the dinitroanthraquinone mixture described in Example 1 was added to the digestion liquor. In this digestion, a Kappa number of 67 was already achieved after a final digestion time of 56 minutes at 175° C. The pulp yield was 53.6%.

EXAMPLE 3

(a) The procedure followed was as in Example 2(a).

(b) The procedure followed was as in Example 2(b). The yield of 51.5% of pulp was already achieved after a final digestion time of 86 minutes at 175° C. The Kappa number was 53.

EXAMPLE 4

(a) Chips of spruce wood were subjected to a sulphate digestion in a laboratory pulp digester. The ratio of digestion liquor to wood was 4:1. The digestion liquor contained 17.5% of effective alkali and had a sulphidity of 47%. The initial digestion time was 60 minutes and the final digestion time at 175° C. was 40 minutes. The pulp yield was 53.7% and the Kappa number was 54.

(b) A further digestion was carried out according to (a), under the same conditions, but 0.1% by weight (relative to oven-dried wood) of a dinitroanthraquinone mixture of the following composition was added to the digestion liquor: 33.0% by weight of 1,6-dinitroanthraquinone, 21.7% by weight of 1,8-dinitroanthraquinone, 21.6% by weight of 1,7-dinitroanthraquinone, 6.5% by weight of 1,5-dinitroanthraquinone, 1.9% by weight of 2,6-dinitroanthraquinone, 1.8% by weight of 2,7-dinitroanthraquinone and 1.4% by weight of 1-nitroanthraquinone.

After a final digestion time of 40 minutes at 175° C., a pulp yield of 52.4% was obtained with a Kappa number of 46.

EXAMPLE 5

(a) Chips of spruce wood were subjected to digestion by the sulphate process at a ratio of digestion liquor to wood of 4:1. The effective alkali, relative to the weight of the wood, was 17.5% and the sulphidity was 47%. After an initial digestion time of 60 minutes and a finishing digestion time of 45 minutes at 175° C., a pulp yield of 52.7% was achieved at a Kappa number of 48.

(b) The procedure followed in a further digestion was according to (a), but 0.1% by weight, relative to oven-dried wood, of the mixture of dinitroanthraquinones indicated in Example 4 was added. A Kappa number of 48 was already achieved after a final digestion time of 39 minutes at 175° C. The pulp yield was 52.7%.

What is claimed is:

1. In the delignification of lignocellulose material by digestion in a liquid containing an anthraquinone-type compound, the improvement which comprises effecting the delignification in a closed reaction vessel at a maximum temperature in the range from 150° to 200° C. for 0.5 to 480 minutes employing as said anthraquinone-type compound a dinitroanthraquinone in 0.001 to 10% by weight of the lignocellulosic material.

2. Process according to claim 1, wherein the dinitroanthraquinone is, 1,5-dinitroanthraquinone, 1,6-dinitroanthraquinone, 1,7-dinitroanthraquinone, 1,8-dinitroanthraquinone, 2,6-dinitroanthraquinone, or 2,7-dinitroanthraquinone.

3. Process according to claim 1, wherein the digesting liquid is an alkaline digestion liquid.

4. Process according to claim 1, wherein a mixture which contains 0 to 3% by weight of 1-nitroanthraquinone, 5 to 12% by weight of 1,5-dinitroanthraquinone, 15 to 35% by weight of 1,6-dinitroanthraquinone, 15 to 35% by weight of 1,7-dinitroanthraquinone, 15 to 50% by weight of 1,8-dinitroanthraquinone, 0.5 to 3% by weight of 2,6-dinitroanthraquinone and 0.5 to 3% by weight of 2,7-dinitroanthraquinone is used as dinitroanthraquinone compound.

* * * * *